United States Patent [19]

Ferro et al.

[11] 4,128,785

[45] Dec. 5, 1978

[54] CORE CONFIGURATION FOR INDUCTION IONIZED LAMPS

[75] Inventors: Armand P. Ferro, Schenectady, N.Y.; Loren H. Walker, Salem, Va.

[73] Assignee: General Electric Company, Schenectady, N.Y.

[21] Appl. No.: 897,208

[22] Filed: Apr. 17, 1978

Related U.S. Application Data

[63] Continuation of Ser. No. 789,514, Apr. 21, 1977, abandoned.

[51] Int. Cl.[2] ..... H01J 7/44; H01J 13/46; H01J 17/34; H01J 19/78

[52] U.S. Cl. ..... 315/57; 315/62; 315/248

[58] Field of Search ..... 315/57, 71, 248, 267, 315/344, 348

[56] References Cited

U.S. PATENT DOCUMENTS

| | | | |
|---|---|---|---|
| 3,987,335 | 10/1976 | Anderson | 315/57 X |
| 4,005,330 | 1/1977 | Glascock | 315/57 |
| 4,017,764 | 4/1977 | Anderson | 315/248 |

*Primary Examiner*—Alfred E. Smith
*Assistant Examiner*—Robert E. Wise
*Attorney, Agent, or Firm*—Lawrence D. Cutter; Joseph T. Cohen; Marvin Snyder

[57] ABSTRACT

The voltage drop in induction ionized lamps is reduced by utilization of annular magnetic cores of inwardly convex cross section. Core power dissipation may be minimized by use of cores having a circular cross section. Lamp voltage drop may further be reduced by eccentrically positioning the core within a substantially globular lamp enevelope.

12 Claims, 6 Drawing Figures

Fig. 5
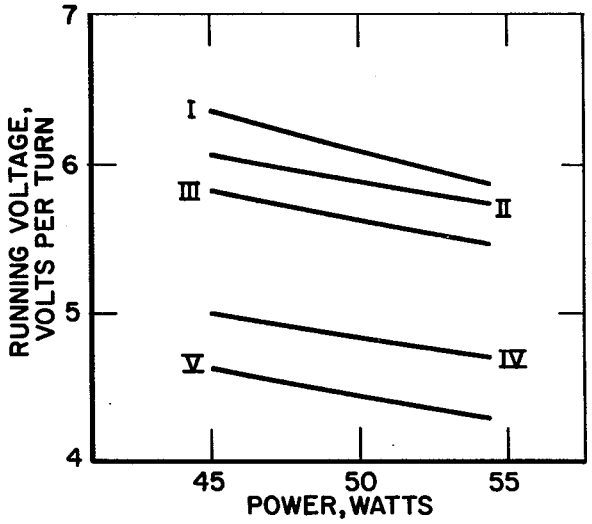
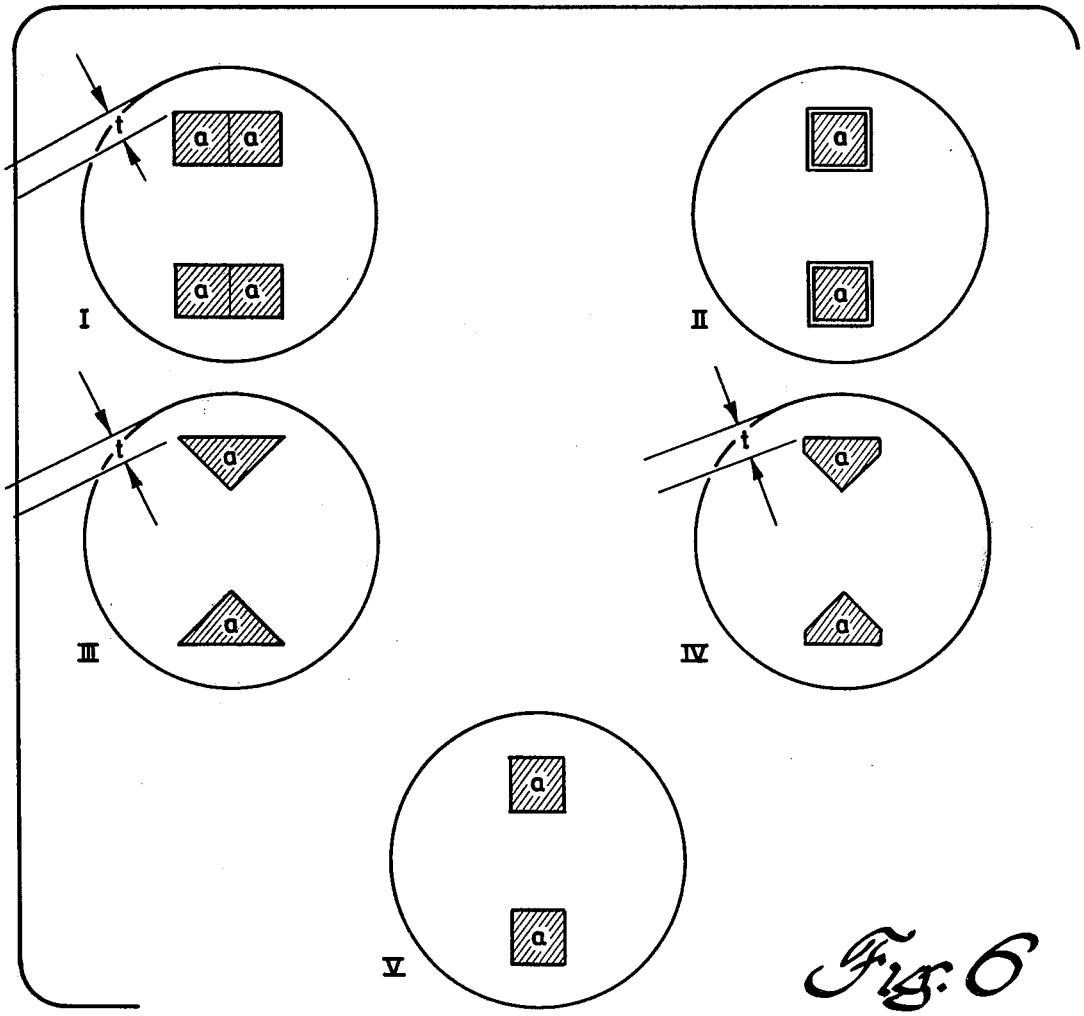
Fig. 6

CORE CONFIGURATION FOR INDUCTION IONIZED LAMPS

This a continuation of application Ser. No. 789,514, filed Apr. 21, 1977, now abandoned.

This invention relates to structures for improving the performance of induction ionized lamps having annular cores contained within substantially globular envelopes. More specifically, this invention relates to magnetic core configurations for reducing voltage drop and core power loss in solenoidal electric field lamps.

BACKGROUND OF THE INVENTION

U.S. Pat. No. 4,005,330 to Homer H. Glascock and John M. Anderson, and allowed U.S. patent application Ser. No. 642,142 filed Dec. 18, 1975 by John M. Anderson, now U.S. Pat. No. 4,017,764, describe induction ionized, electrodeless fluorescent lamps wherein a high frequency, solenoidal electric field is established by a transformer which is centrally disposed with respect to a substantially globular lamp envelope. The lamps described in those patents may be produced in a form which is electrically and mechanically compatible with common, screw-base, incandescent lamps and which provides substantially more efficient operation than conventional incandescent lamps.

The transformer which is utilized in the above-described fluorescent lamps generally comprises a primary winding coupled to a closed loop magnetic core, which is typically ferrite. The core is centrally disposed with respect to the lamp envelope and is coupled to a fill-gas therewithin. During lamp operation, power is transferred to a plasma in the gas which forms a "single turn secondary" linking the transformer core. The voltage drop around the plasma secondary, which is a function of the lamp geometry, the fill-gas composition, and the fill-gas pressure, acts to determine the peak magnetic flux level within the transformer core. Power dissipation within ferrite cores is known to increase, with a commensurate decrease in transformer efficiency, at increased magnetic flux levels. It is, therefore, desirable to reduce the plasma voltage drop and, thus the peak transformer magnetic flux level, in these lamps.

The saturation flux density in those ferrite materials which are suitable for use in the above-described transformer cores decreases rapidly if the core temperature exceeds a critical level, typically in the vicinity of 125° C. It is, therefore, necessary to provide structures for limiting the maximum temperature of magnetic cores within induction ionized lamps. The above-referenced patents describe structures for transferring heat from a magnetic core to the external environment of a fluorescent lamp.

U.S. Pat. No. 4,005,330 and allowed U.S. patent application Ser. No. 642,142, now U.S. Pat. No. 4,017,764, are incorporated by reference in this specification, as background material.

SUMMARY OF THE INVENTION

We have determined that the voltage drop in the plasma secondary of an induction ionized fluorescent lamp is largely determined by the geometry of the central opening, or tunnel, in the annular transformer core. The voltage drop in such lamps may be substantially reduced by use of transformer cores which present a convex cross section adjacent the tunnel region. Core operating temperature may, also, be minimized with a core geometry having an over-all circular cross section.

The voltage drop in electrodeless fluorescent lamps has also been found to vary as a function of the geometry of the largest available path for the plasma secondary. The voltage drop may, thus, be reduced by eccentrically positioning the core with respect to the lamp envelope.

It is, therefore, an object of this invention to decrease the voltage drop in induction ionized fluorescent lamps.

Another object of this invention is to increase the efficiency of induction ionized fluorescent lamps.

Another object of this invention is to reduce the power dissipation and the temperature in the transformer cores of induction ionized fluorescent lamps.

BRIEF DESCRIPTION OF THE DRAWINGS

The novel features believed characteristic of the present invention are set forth in the appended claims. The invention itself, together with further objects and advantages thereof, may best be understood by reference to the following detailed description taken in connection with the appended drawings in which:

FIG. 5 is a plot of running voltage versus power input for induction ionized fluorescent lamps which comprise magnetic cores of the present invention; and FIG. 6 illustrates the magnetic core configurations characterized in the plots of FIG. 5.

DESCRIPTION OF THE PREFERRED EMBODIMENTS

Figure 1:
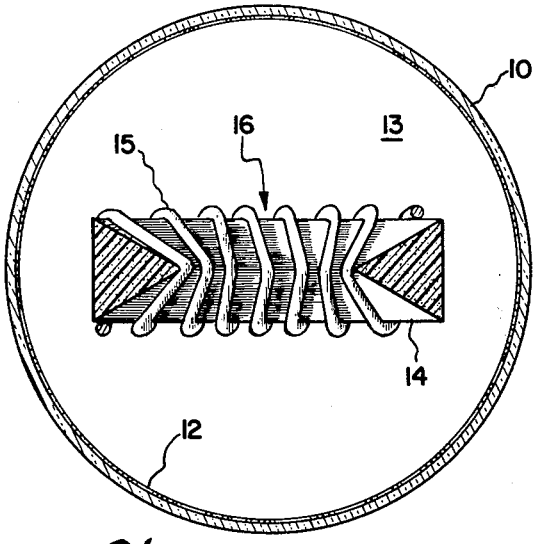
FIGS. 1 and 2 are top sectional views of internal core, solenoidal electric field fluorescent lamps which comprise magnetic cores of the present invention.

FIG. 1 is a top sectional view of an induction ionized, solenoidal electric field fluorescent lamp, having an internal transformer core, which is more specifically described in the above-referenced patent application Ser. No. 642,142, now U.S. Pat. No. 4,017,764. A substantially globular light-transmissive envelope 10 is internally coated with a fluorescent lamp phosphor 12 and filled with an ionizable gas 13 of the type commonly utilized in fluorescent lamps, for example, a mixture of argon and mercury vapor. An annular magnetic core 14, which typically comprises ferrite, is disposed within the gas 13 in the envelope 10. The core 14 is linked with a multi-turn primary winding 15 which is connected to a source of radio frequency electric power (not illustrated). Current flowing through the primary 15 induces a solenoidal electric field which links the core 14 and ionizes the gas 13 to form a plasma. Current flow in the plasma then acts as a single turn secondary on the transformer core 14.

The secondary plasma linking the magnetic core 14 determines the voltage drop per turn in the primary winding 15. This voltage drop affects several important lamp parameters; most notably, the flux density in the core and attendant core losses. The core loss per unit volume of ferrite material depends superlinearily on flux density; thus, a reduction in the voltage drop of the secondary plasma will greatly reduce losses in the magnetic core 14. We have determined that there are two major physical lamp parameters which can be adjusted to reduce the voltage drop in the secondary plasma: (1) the geometry of the tunnel region 16; that is, the central core opening, and (2) the constriction between the surface of the core 14 and the outer envelope 10.

We have determined that the voltage drop in the secondary of an induction ionized fluorescent lamp may be reduced by increasing the effective diameter of the core opening and by decreasing the effective length of that opening. For a lamp envelope of fixed dimensions, these effects may be most readily accomplished by use of an annular core 14 having substantially concave surfaces adjacent the opening. FIG. 1 illustrates an annular core, having a substantially triangular cross section with an inwardly directed apex, which is particularly effective for reducing plasma voltage drop in the tunnel region 16.

Figure 2:
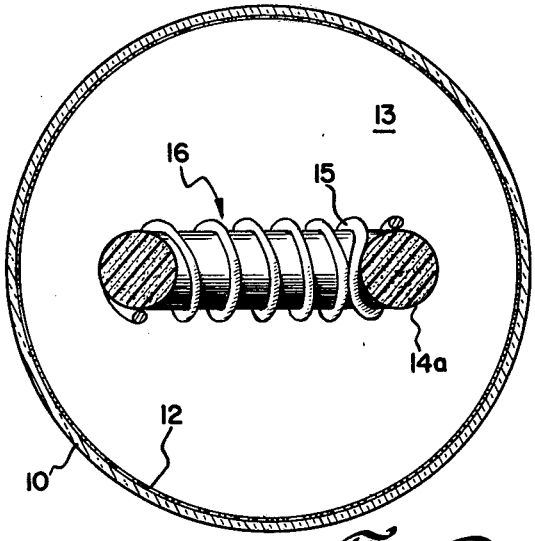

The saturation magnetic flux density is known to decrease and the level of core losses are known to increase in ferrites at high temperatures. Plasma recombination processes at the surface of a ferrite core are known to produce substantial heat which is transferred to the ferrite. FIG. 2 is an internal core induction ionized fluorescent lamp, of the type described in FIG. 1, which comprises an annular transformer core 14*a* of substantially circular cross section. For a fixed volume of ferrite material, this core configuration minimizes ferrite surface area and thus tends to minimize plasma heating of the ferrite, while simultaneously reducing voltage drop in the tunnel region 16.

Figure 3:
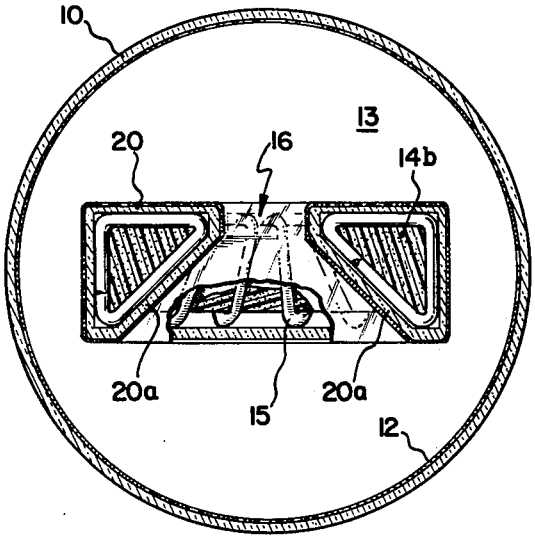
FIG. 3 is a top sectional view of an external core, solenoidal electric field fluorescent lamp which comprises a magnetic core of the present invention.

The principles of the present invention may also be practiced with external core induction ionized lamps of the type described in U.S. Pat. No. 4,005,330. FIG. 3 is a top sectional view of an external core induction ionized fluorescent lamp comprising a substantially globular light-transmissive envelope 10 which is internally coated with a phosphor 12 and filled with an ionizable gas 13. An annular magnetic core 14*b* is disposed in a reentrant channel 20 formed from the lamp envelope and is thus external to but centrally disposed within the envelope 10; linking the gas 13. In accordance with the present invention, the plasma voltage drop in the tunnel region 16 of an external core fluorescent lamp may be reduced by increasing the effective diameter of the tunnel region and decreasing its effective thickness. The tunnel geometry may, thus, be modified by forming the channel 20 and magnetic core 14*b* with an internally directed convex surface, for example, a triangular geometry with an inwardly directed apex. As an example, external core fluorescent lamps may be advantageously constructed with the tunnel walls 20*a* formed as the hypotenuse of a substantially right triangular channel. Lamps of this geometry may be constructed by forming the internal channel wall 20*a* in the form of a glass funnel which is inserted in an annular core of right triangular cross section and formed into a lamp header in a manner which is more particularly described in the referenced patent.

Figure 4:
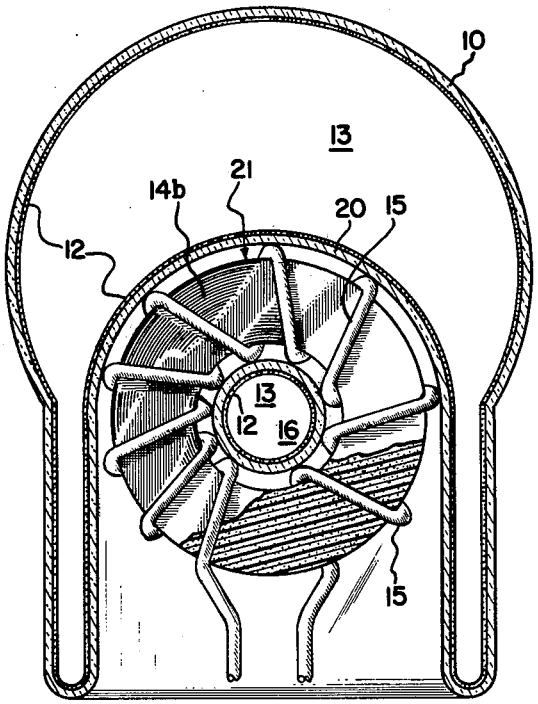
FIG. 4 is a side sectional view of the lamp of FIG. 3.

Prior art solenoidal electric field fluorescent lamps were generally constructed with the annular transformer centrally disposed within a substantially spherical envelope in an attempt to maximize the smallest passage through which the plasma passed. We have determined that the plasma voltage drop may be significantly decreased by an asymmetrical placement of the core within the lamp envelope. FIG. 4 is an external core fluorescent lamp wherein the magnetic core 14*b* is eccentrically disposed within the lamp envelope, the central circumference 21 of the core 14*b* passing through the approximately center of the substantially spherical envelope 10. The plasma voltage drop is thus decreased.

FIGS. 5 and 6 illustrate the effects of core geometry and placement on the running voltage of a series of substantially identical, internal core fluorescent lamps. In all cases, the lamps were constructed in four inch diameter glass globes filled with 0.7 torr argon and were operated at 50 kHz.

Curve I is characteristic of a transformer core comprising two annular ferrite cores of square cross section placed side by side. This configuration produced the longest tunnel length with the shortest core-to-envelope constriction *t* and thus, operated at a high running voltage.

Curve II is characteristic of a single ferrite core of square cross section enclosed in an aluminum shell. The effects of decreased tunnel length and decreased tunnel diameter apparently canceled to yield a relatively high voltage drop; although somewhat lower than the core I.

Curve III is characteristic of a core constructed from two ferrite rings of square cross section which was shaped to produce a single core of triangular cross section and unit area *a*. The symmetrical triangular shape of ferrite core III produced a slightly lower voltage drop than core I. In this case, while the tunnel parameters were favorably improved, the effect could have been offset by a constriction of the distance *t*, which is exactly the same *a* with core I. This effect is illustrated by core IV which is substantially idential to core III, with chamfered corners which reduce the core-to-envelope constriction *t*. Curve V is characteristic of a single core of square unit cross section *a* which effectively reduces the tunnel length and plasma constriction. Core V may be seen to operate with approximately 25 percent less running voltage than core II, which may be shown to yield a power loss reduction of approximately three times with respect to core I.

The core geometry of the present invention allows reduced plasma drop in induction ionized, solenoidal electric field lamps and thus provides decreased core loss factors, lower core temperatures, and higher operating efficiency than did core geometries of prior art lamps.

While the invention has been described in detail herein in accord with certain preferred embodiments thereof, many modifications and changes therein may be effected by those skilled in the art. For example, while the embodiments of the invention have been described herein with reference to fluorescent lamps, the invention is equally applicable to other forms of induction ionized discharge lamps. Accordingly, it is intended by the appended claims to cover all such modifications and changes as fall within the true spirit and scope of the invention.

The invention claimed is:

1. In an induction ionized, solenoidal electric field lamp of the type comprising a mass of an ionizable gas and transformer means, including a closed loop magnetic core linking said gas, which function to induce a high frequency electric current flow in said gas; the improvement wherein:

said magnetic core is of a substantially toroidal shape, defining a central tunnel opening, the generatrix of said core having reduced thickness, as measured along the direction parallel to the axis of said toroidal core, in regions adjacent said tunnel opening.

2. The lamp of claim 1 wherein said core comprises ferrite.

3. The lamp of claim 1 wherein said core has a substantially circular cross section.

4. The lamp of claim 1 wherein said lamp further comprises a substantially globular light-transmissive envelope enclosing said gas and wherein said core is disposed within said envelope.

5. The lamp of claim 4 wherein said core has a substantially triangular cross section.

6. The lamp of claim 5 wherein said core has a right triangular cross section, the hypotenuse of said cross section lying adjacent and forming a boundary of said tunnel region.

7. The lamp of claim 4 wherein said core is spaced from said envelope to define a plasma constriction and wherein the corners of said core adjacent said plasma constriction are chamfered to increase the area of said constriction.

8. The lamp of claim 4 wherein said core is eccentrically disposed with respect to an axis of said envelope.

9. The lamp of claim 8 wherein said core is spaced from said envelope to define a plasma constriction and wherein the corners of said core adjacent said plasma constriction are chamfered to increase the area of said constriction.

10. The lamp of claim 1 wherein said lamp further comprises a substantially globular lighttransmissive envelope enclosing said gas and wherein said core is disposed in a dielectric channel of said envelope and is separated from said gas by said envelope.

11. The lamp of claim 10 wherein the cross section of said channel is similar to the cross section of said core.

12. The lamp of claim 11 wherein the axis of said toroid is eccentrically disposed with respect to an axis of said globular envelope.

* * * * *